US007814969B2

(12) United States Patent
Shaw

(10) Patent No.: US 7,814,969 B2
(45) Date of Patent: Oct. 19, 2010

(54) WET MATE CONNECTION FOR ESP PUMPING SYSTEM

(75) Inventor: Chris K. Shaw, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 71 days.

(21) Appl. No.: 12/060,525

(22) Filed: Apr. 1, 2008

(65) Prior Publication Data

US 2009/0242212 A1 Oct. 1, 2009

(51) Int. Cl.
*E21B 17/00* (2006.01)
*E21B 23/01* (2006.01)

(52) U.S. Cl. ..... 166/65.1; 166/378; 166/242.6

(58) Field of Classification Search ..... 166/370, 166/378, 106, 107, 117, 242.6, 242.1, 242.7, 166/65.1; 439/191, 19
See application file for complete search history.

(56) References Cited

U.S. PATENT DOCUMENTS 1,678,280 A * 7/1928 Carson ..... 285/332
4,426,124 A * 1/1984 Vandevier ..... 439/271
4,589,492 A 5/1986 Greiner et al.
5,174,765 A * 12/1992 Williams et al. ..... 439/86
6,003,599 A * 12/1999 Huber et al. ..... 166/255.2
6,179,585 B1 1/2001 Kobylinski et al.
6,298,917 B1 10/2001 Kobylinski et al.
6,415,869 B1 7/2002 Smith
6,682,309 B2 1/2004 Reid
6,695,052 B2 2/2004 Branstetter et al.
6,702,027 B2 3/2004 Olson et al.
6,780,037 B1 8/2004 Parmeter et al.
2002/0050361 A1 5/2002 Shaw et al.
2006/0243450 A1 11/2006 Head
2007/0275585 A1* 11/2007 Griffiths ..... 439/275

OTHER PUBLICATIONS

A.R. Baillie, Amoco Production Co., Jing Hui Chen, Nanhai East Oil Corp. OTC 7063, Liuhua 11-1 Field Development: An Innovative Application of Technology, p. 693-700, 24th Annual OTC, Houston, Texas, May 4-7, 1992.
James M. Rohloff, Douglas R. Bourne, Amoco Orient Petroleum Company, Yao Jun Shan, China Offshore Oil Nanhai East Corporation, James Reid, Lasalle Engineering, Donald H. Hay, Aker Omega Inc., OTC Paper 8176, Liuhua 11-1 Development—Downhole Completion Program with Electric Submersible Pumps and Wet-Mateable Electrical Connectors,, p. 235-242, 28th Annual OTC, Houston, Texas, May 6-9, 1996.
Weatherford / SubTech cable/CT deployed ESP System, 4 pages, copyright 1999 SubTech International Inc.

* cited by examiner

*Primary Examiner*—Jennifer H Gay
*Assistant Examiner*—Michael Wills, III
(74) *Attorney, Agent, or Firm*—Bracewell & Giuliani LLP

(57) ABSTRACT

A submersible pumping system for use downhole, wherein the system includes tubing disposed in a wellbore having a wet connection formed for coupling with a pumping system disposable in the tubing. An electrical power cable connects to the wet connection through the tubing. The wet connection comprises receptacles configured to mate with electrically conducting pins, the receptacles and the pins are oriented substantially parallel with the tubing axis. The receptacles are formed to receive the pins therein and form an electrical connection for connecting electrical power from the cable to the pumping system.

11 Claims, 3 Drawing Sheets

WET MATE CONNECTION FOR ESP PUMPING SYSTEM

BACKGROUND

1. Field of Invention

The present disclosure relates to downhole pumping systems submersible in well bore fluids. More specifically, the present disclosure concerns lowering a submersible pump through tubing and connecting it electrically to an electrical receptacle mounted in the tubing.

2. Description of Prior Art

Submersible pumping systems are often used in hydrocarbon producing wells for pumping fluids from within the wellbore to the surface. These fluids are generally liquids and include produced liquid hydrocarbon as well as water. One type of system used in this application employs an electrical submersible pump (ESP). ESPs are typically disposed at the end of a length of production tubing and have an electrically powered motor. Often electrical power may be supplied to the pump motor via a power cable. Normally, the power cable is strapped to the tubing or lowered along with the pump and the tubing. Typically, the pumping unit is disposed within the well bore just above where perforations are made into a hydrocarbon producing zone. ESP's typically require periodic retrieval for scheduled maintenance or repair. This usually entails removing the power cable, which is secured alongside the tubing. Pulling and reusing the power cable mechanically wears the cable and can sometimes damage the cable.

SUMMARY OF INVENTION

The present disclosure includes a system for producing fluids from a hydrocarbon producing wellbore, the system comprises production tubing disposed within the wellbore, a pumping system having a pump with fluid inlets, and a pump motor mechanically coupled to the pump. The pumping system is deployable through the production tubing. A pedestal is affixed within the production tubing and configured to matingly couple with the pumping system. Also included is an electrical power supply line connected to a power source that terminates within the pedestal and a wet mate connector in electrical communication with the pump motor and the electrical power supply having receptacles and pins configured for insertion into the receptacles. Inserting the pins into the receptacles provides electrical communication between the pump motor and the electrical power supply.

In one embodiment, a first portion of the wet mate connector is provided on the pump motor and a second portion of the wet mate connector is provided on the pedestal. The receptacles and pins are oriented substantially parallel to the production tubing. In one embodiment, the receptacles are coupled to the pump motor and hardwired into electrical communication with the pump motor and the pins are disposed on the pedestal and hardwired into electrical communication with the electrical power supply. Optionally the pins may be coupled to the pump motor and hardwired into electrical communication with the pump motor and the receptacles are disposed on the pedestal and hardwired into electrical communication with the electrical power supply.

The present disclosure also includes an electrical submersible pumping system deployable in wellbore production tubing. The pumping system comprises a pump having a fluid inlet, a pump motor coupled to the pump, and a wet mate connection component with electrical receptacles provided therein in electrical communication with the pump motor.

The connection component may be coupled to the pump motor with the electrical receptacles oriented substantially parallel to the production tubing. The electrical receptacles are formed to receive electrically conducting pins therein. The wet mate connection component may comprise a base portion affixed to the pump motor and an annular skirt coaxial with the pump motor which extends away from the pump motor thereby defining a recess bounded by the skirt and base. Optionally, the receptacles may be disposed on the base and extend into the recess. The wet mate connection component may be configured for mating connection with a corresponding wet mate connection component affixable to the production tubing. The corresponding wet mate connection is configured for insertion into the recess and the corresponding wet mate connection includes on its mating surface the electrically conducting pins. Mating connection between the wet mate connection component and the corresponding wet mate connection component provides electrical power to the pump motor.

Also disclosed herein is an annular sub member disposed within wellbore production tubing comprising a pedestal provided in the sub member and affixed thereto, the pedestal having a portion configured to receive thereon a pumping system deployed within the production tubing, an electrical power cable in the pedestal, and a wet mate connection component on the pedestal having electrically conductive pins extending from the pedestal and substantially parallel to the sub member, the pins in electrical communication with the electrical power cable and configured to mate with corresponding receptacles provided on the pumping system. The sub may include connections on its respective terminal ends for connection to production tubing. A shoulder may be included formed on the pedestal outer surface configured for mating support with the pumping system. An orientation device on the pedestal may also be included with the sub member that azimuthally aligns the pins with the corresponding receptacles.

BRIEF DESCRIPTION OF DRAWINGS

Some of the features and benefits of the present invention having been stated, others will become apparent as the description proceeds when taken in conjunction with the accompanying drawings, in which.

Figure 1:
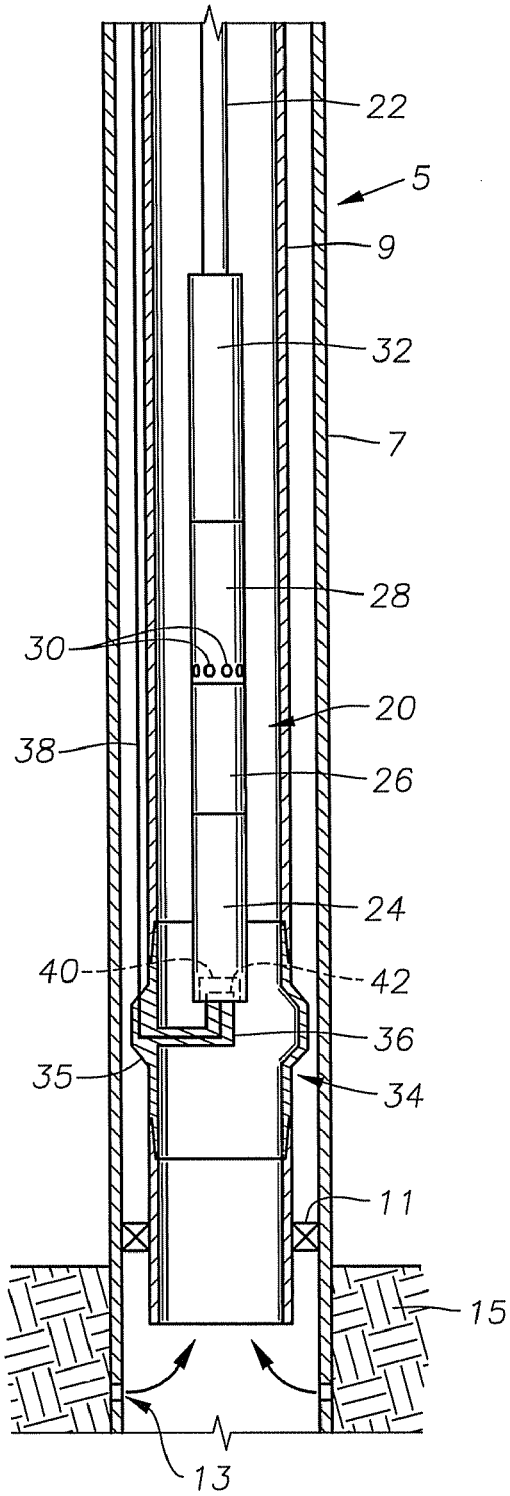
FIG. 1 is a side partial cross sectional view of an ESP disposed in production tubing with a wet mate connection.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location. It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 1 provides a side partial cross sectional view of an embodiment of an ESP pumping system 20 used for delivering produced subterranean fluid to the surface of the wellbore. The ESP pumping system 20 is inserted in production tubing 9 deployed in a wellbore 5. The wellbore 5 is lined with casing 7 with the production tubing 9 affixed within the casing 7. In the embodiment shown, the production tubing 9 includes a wet matable connection 34 for transmitting electrical power to the pumping system 20. The wet matable connection 34 is included at the production tubing's 9 the lower end. The production tubing 9 terminates in the wellbore 5 adjacent perforations 13. The perforations 13 are formed through the casing 7 and into a hydrocarbon producing formation 15 that circumscribes a portion of the wellbore 5. Fluid flow, shown as arrows, enters the wellbore 5 from the formation 15 and through the perforations 13. As shown in this example, the fluid enters the open end of the production tubing 9 and is drawn upwards to the ESP pumping system 20.

The ESP pumping system 20 comprises a pump motor 24, a seal section or equalizer 26 on the upper end of the pump motor 24, an optional gas separator 28, and a pump 32. Fluid inlets 30 are provided on the optional separator 28 through which produced fluid can be drawn into the pumping system 20. After passing through the inlets 30 the fluid flows to the pump 32 where it is pressurized and discharged into a smaller diameter tubing 22 extending from the upper end of the pump 32. If used, gas is separated by the gas separator 28 and discharged into the annulus surrounding the pumping system 20.

A power cable 38 is disposed in the wellbore and connected to the pump motor 24. The power cable 38 extends down the wellbore 5 in the annular region between the casing 7 and the production tubing 9. The power cable 38 passes through the housing 35 which lines the wet matable connection 34. A pedestal 36 is shown affixed on the inner surface of the housing 35 that provides a wet mate connection for connecting to the pump motor 24 and electrical power supply while down hole. The pump system 20 includes a pump connector 40 on the portion of the pump motor 24 that couples onto the pedestal 36. This portion of the pump motor 24 may be the bottom of the stator and rotor, or may be the bottom of an instrument module included at the lower end of the pump motor 24. A corresponding pedestal connector 42 is provided on the portion of the pedestal 36 that mates with the pump motor 24.

The pumping system 20 is typically deployed after the production tubing (9, 10) (with its wet matable connection 34) is set within the casing 7. Optional packers 11 are shown proximate to the lower terminal end of the production tubing 10 for setting the production tubing and directing produced fluid from the perforations 13 to the entrance of the tubing 10. The power cable 38 is affixed to the web matable connection 34 prior to tubing deployment.

Figure 2:
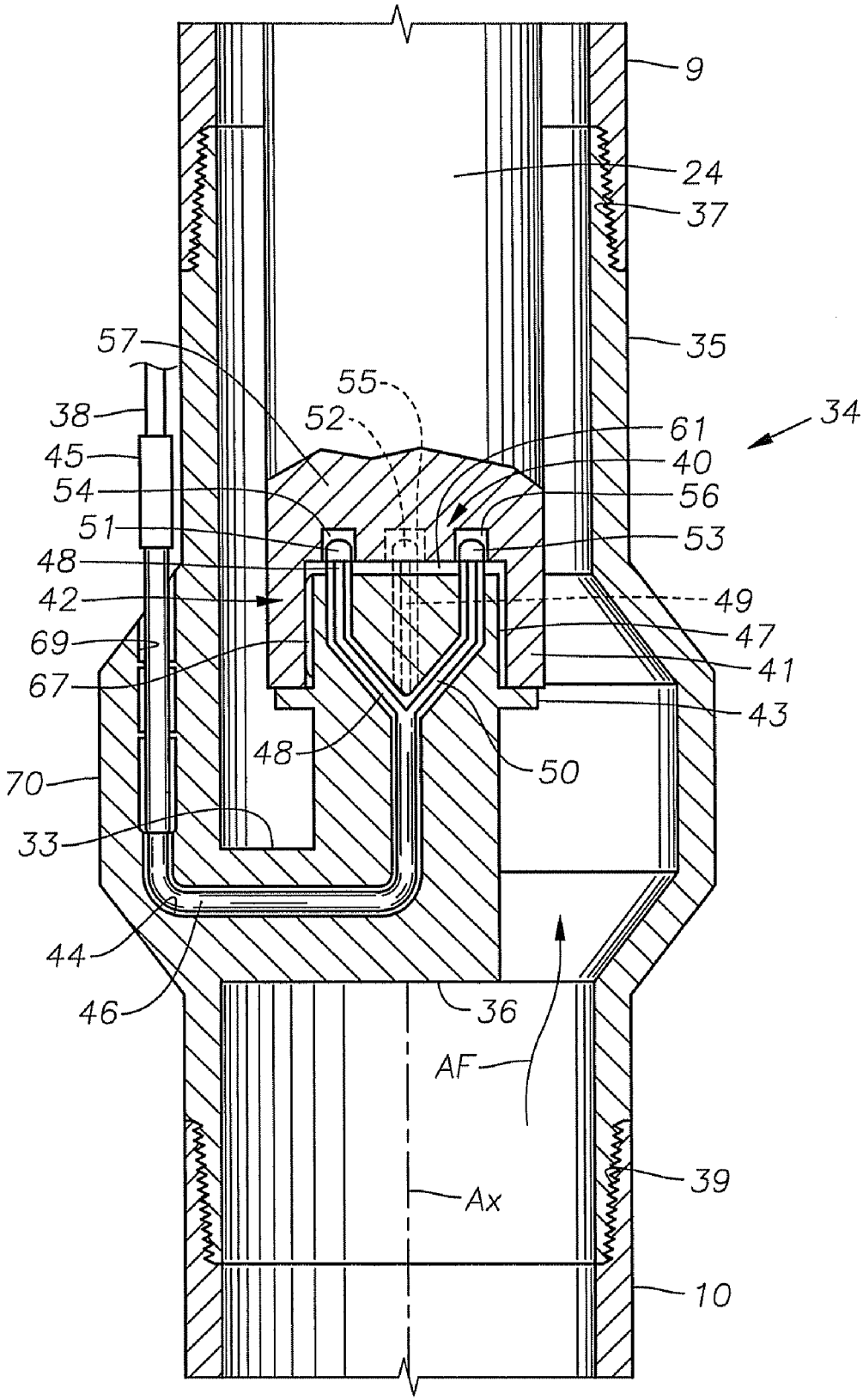
FIG. 2 is a side partial cross sectional view of an embodiment of a wet mate connection in a tubing sub.
Figure 5:
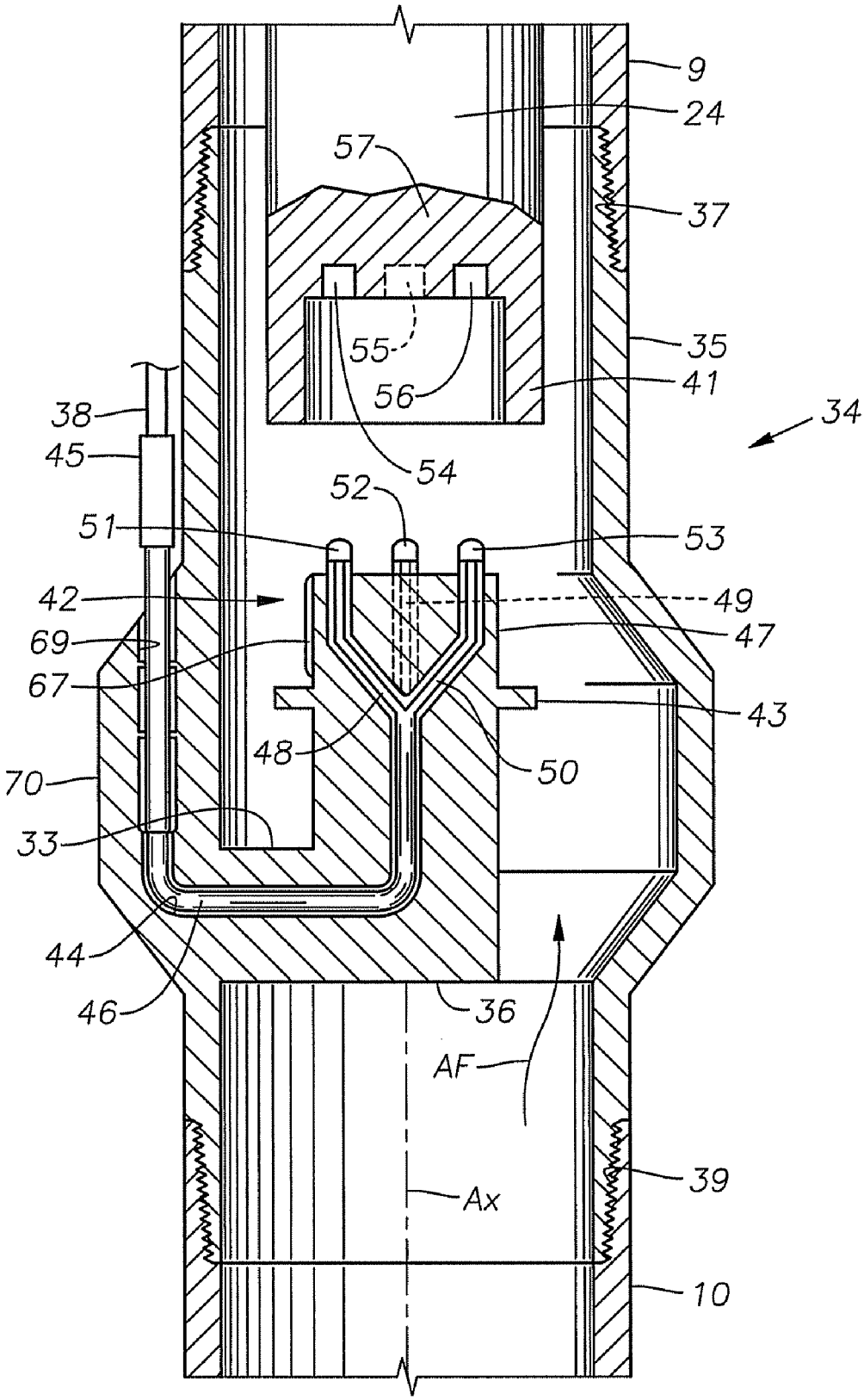
FIG. 5 is a view similar to FIG. 2, but showing the pump motor being lowered into engagement with the pedestal.

FIG. 2 illustrates a partial cross sectional view of an embodiment of a wet matable connection 34. The connection 34 comprises an outer housing 35 having threads 37 for coupling to the upper production tubing 9 and threads 39 for connecting to the lower production tubing 10. The connection 34 also comprises a pedestal 36 having a base portion 33 mechanically affixed to the inner circumference of the housing 35. The base portion 33 extends into the middle hollow portion of the housing 35 perpendicular to the axis $A_x$ of the housing 35. The pedestal 36 farther includes a pedestal connector 42 which attaches to the terminal end of the pedestal base 33. The pedestal connector is generally cylindrical and elongated, and as shown, its elongated portion is oriented substantially parallel to the axis $A_x$ of the housing 35.

The power cable 38 terminates in a cable connector 45 (commonly referred to as a pothead connector), the cable connector 45 inserts into a receptacle 69. The receptacle 69 is received in a connector housing 70 which protrudes from the wet mateable connection 34 outer surface. A cable passage 44 is formed in the connector housing 70 and through the pedestal 36; a pedestal cable 46 extends through the passage 44 from the end of the connector 45, through the pedestal base 33, and into the pedestal connector section 42. To accommodate the 3 phase power supply, the pedestal cable 46 splits into three different leads (48, 49, 50). The leads (48, 49, 50) travel in the same or separate passages and terminate proximate to the upper end of the pedestal connector 42. Connection pins (51, 52, 53) are provided on the ends on each of the respective leads (48, 49, 50) that rise upward past the upper surface of the pedestal connector 42. As shown, the pins (51, 52, 53) extend generally parallel with the axis $A_x$ of the housing 35.

The lower end of the pump motor 24 is provided with a pump connector 40 that comprises a connector base 57 and an annular skirt 41. The connector base 57 is largely planar having an upper surface mating with the lower terminal end of the pump motor 24. Extending from the outer periphery of the base 57, the annular skirt 41 extends downward having a hollow space therein forming a recess 47. The recess 47 insertingly receives the pedestal connector 42 therein. Electrical receptacles (54, 55, 56) are provided on the base 57 and have a generally annular configuration as shown. The receptacles (54, 55, 56) are formed to receive the pins (51, 52, 53) therein and are also generally aligned with the axis $A_x$ of the housing 35. Thus seating the pumping system 20 onto the pedestal 36 couples the pedestal connector 42 with the pump connector 40.

The receptacles (54, 55, 56) are in electrical communication with the pump motor 24, therefore coupling the pedestal connector 42 to the pump connector 40 provides electrical communication between the pump motor 24 and the power cable 38. Moreover, the connector 34 is designed for "wet mating" two electrical connectors in a wet environment. Thus electrical connection for the pump motor 24 may occur while fluid is present within the housing 35. A plenum 61 exists between the pedestal connector 42 and the connector base 57. The plenum 61 may include wellbore fluid while coupling the connectors (40, 42). After seating the motor 24 onto the pedestal 36 and mating the connectors (40, 42), the plenum 61 may be flushed to remove wellbore fluid from the plenum 61. A dielectric fluid may be then injected into the plenum space 61. The dielectric fluid could be injected from the surface via a small tube incorporated with the power cable 38.

A shoulder 43 is shown on the outer circumference of the pedestal connection 42 on which the annular skirt 41 may rest when the motor 24 seats onto the pedestal 36. The shoulder 43 supports the annular skirt 41 thereon and prevents further downward movement of the motor 24. This distributes weight onto the shoulder 43 and not the pins, which prevents mechanical damage to the respective pins and receptacles. Also on the outer surface of the pedestal connector 42 is an orientation guide 67 for use in aligning the respective pins and receptacles for proper electrical connection to the pump motor 24.

Figure 3:
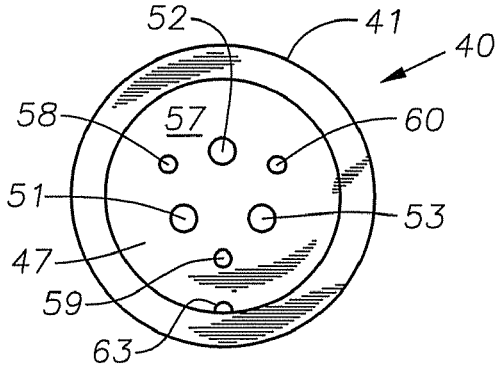
FIG. 3 is an upward looking view of an embodiment of a portion of a wet mate connection.

FIG. 3 provides an upward looking view of an embodiment of the lower portion of the pump connector 40 and into the recess 47. Here the receptacles (51, 52, 53) extend downward from the lower planar surface of the base 57, which is circumscribed by the annular skirt 41. Optional alignment pins (58, 59, 60) also extend downward from the lower planar portion of the base 57 which may be used for alignment with corresponding bores (not shown) in the upper surface of the pedestal connector 42.

Figure 4:
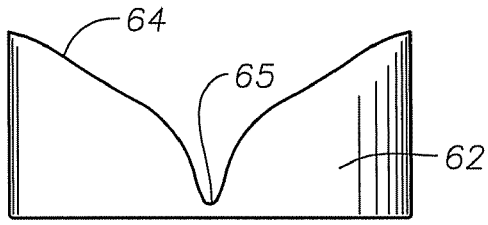
FIG. 4 is a side view of an embodiment of an azimuthal orientation device.

FIG. 4 is a side perspective view of a raised profile 62 that may be either on the outer circumference of the pedestal connector 42 or the inner surface of the annular skirt 41. The raised profile 62 represents 360° of travel around one of these members. The profile 62 comprises a curved raised shoulder 64 extending outward from the respective surface. In one embodiment, the shoulder 64 is generally helical. With reference now to FIG. 3, the annular skirt 41 includes a guide pin 63 on its inner circumference for engaging the raised shoulder 64. Landing the guide pin 63 at any location on the raised shoulder 64 with downward force will slide the guide pin towards the low point 65 thereby aligning the respective connectors (40, 42) such that the pins (51, 52, 53) are aligned with respective receptacles (54, 55, 56). It should be pointed out however that the location of the receptacles and the pins may be reversed so that the pins extend downward from the lower planar surface of the base 57 and the receptacles are disposed on the upper surface of the pedestal connector for engaging the pins. For the purposes of discussion herein, the term hardwired refers to a solid electrical conduit extending between different component parts of the apparatus described herein.

With reference now to FIG. 2, the housing 35 radius bulges outward proximate to the pedestal 36 to assure free flow of well fluid past the pedestal 36. The pedestal 36 could extend to the other side of the housing 35 and have flow-through passages defined by spokes, similar to a spider. Optional embodiments exist wherein the tubing radius is substantially consistent along the length of the connector 34 without an outward bulge.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims. For example, rather than running the pump assembly into tubing and discharging the fluid through tubing, it could be run on a lift line cable or coiled tubing. A packer would be located around the pump above the intake and below the discharge. The discharge would be into the large diameter tubing above the packer. The packer could have a latch to support the weight of the ESP, allowing the lift line cable or coiled tubing retrieval.

The invention claimed is:

1. A system for producing fluids from a hydrocarbon producing wellbore comprising:

a string of tubing disposed within the wellbore;

a pumping system deployable through the tubing and having a pump with fluid inlets, and a pump motor mechanically coupled to the pump;

an annular downward extending skirt on a lower end of the motor, defining a pedestal connector with an inner cylindrical sidewall and a recessed downward-facing base at an upper end of the sidewall, a plurality of motor electrical contacts mounted to the base and spaced laterally apart from each other in a selected pattern relative to a longitudinal axis of the motor, the motor electrical contacts being surrounded by the skirt and in selective electrical communication with the pump motor;

a power cable extending downward-between the cased wellbore and the tubing;

a pedestal affixed within the tubing, the pedestal being an upright member having an outer cylindrical sidewall for reception within the pedestal connector and an upper end facing upward;

a plurality of pedestal electrical contacts at the upper end of the pedestal and electrically connected with a lower end of the power cable, the pedestal electrical contacts being laterally spaced apart from each other relative to the longitudinal axis in a pattern that matches the pattern of the motor electrical contacts; and a profile on one of the cylindrical sidewalls and a guide pin on the other of the cylindrical sidewalls for orienting the motor electrical contacts with the pedestal electrical contacts.

2. The system of claim 1, wherein the guide pin is mounted to and projects radially inward from inner cylindrical sidewall, and the profile is formed on the outer cylindrical sidewall.

3. The system of claim 1, wherein the motor and the pedestal electrical contacts comprise pin receptacles and pins that are oriented substantially parallel to the longitudinal axis.

4. The system of claim 1, wherein the tubing has an enlarged interior width at the pedestal, the enlarged interior width being larger than diameters of the tubing above and below the pedestal, to provide a desired fluid flow area between the pedestal and the tubing.

5. The system of claim 1, further comprising an external shoulder on the outer cylindrical sidewall of the pedestal below the upper end of the pedestal, the shoulder being contacted by a lower end of the skirt to stop downward movement of the pumping system as the pumping system lands on the pedestal.

6. The system of claim 5 wherein the base of the pedestal connector and the upper end of the pedestal are spaced apart from each other when the lower end of the skirt contacts the shoulder.

7. An electrical submersible pumping system deployable in wellbore production tubing, the pumping system comprising:

a pump having a fluid inlet;

a pump motor coupled to the pump;

a power cable extending along an outer side of the production tubing;

a cylindrical skirt on a lower end of the motor, the skirt having an inner cylindrical sidewall and a flat base located at an upper end of the inner cylindrical sidewall, the base being in a plane perpendicular to a longitudinal axis of the motor;

a plurality of motor electrical contacts in a pattern on the base;

a pedestal sub having an upper threaded section secured to an upper portion of the string of tubing and a lower threaded section secured to a lower portion of the string of tubing, the sub having a central area with interior and exterior surfaces that bulge outward relative to the upper and lower threaded sections;

a pedestal affixed within the central area of the sub, the pedestal having an outer cylindrical sidewall and a flat upper end;

a plurality of pedestal electrical contact in a pattern on the flat upper end that matches the pattern of the motor electrical contacts, the pedestal electrical contacts being electrically connected to the power cable;

an external shoulder on the pedestal below the upper end, a lower end of the skirt contacting the shoulder to limit downward movement of the motor as the motor lands on the pedestal; and a raised profile on one of the cylindrical sidewalls and a guide pin on the other of the cylindrical sidewalls for orienting the motor electrical contacts with the pedestal electrical contacts.

8. The electrical submersible pumping system of claim 7, wherein the guide pin is mounted to and projects radially inward from within the inner cylindrical sidewall, and the profile is formed on the outer cylindrical sidewall.

9. The electrical submersible pumping system of claim 8, wherein the motor and the pedestal electrical contacts and connections respectively comprise pin receptacles and pins that are oriented substantially parallel to the string of tubing longitudinal axis.

10. The electrical submersible pumping system of claim 7 wherein the base and the upper end of the pedestal are spaced apart from each other when the lower end of the skirt contacts the shoulder, defining a plenum for receiving a dielectric flushing fluid.

11. A method of installing a submersible pump system in a cased wellbore, comprising:

providing a power cable with electrical conductors and a tube;

providing a string of tubing with a pedestal sub having an upright pedestal within and pedestal electrical contacts and a flushing fluid passage within the pedestal leading to the area of the pedestal electrical contacts;

electrically connecting the conductors of the power cable to the pedestal electrical contacts and connecting the tube to the flushing fluid passage within the pedestal; then lowering the string of tubing into the cased wellbore while strapping the power cable alongside the string of tubing;

providing a pumping system with a pump and a pump motor mechanically coupled to the pump, the motor having a pedestal connector on a lower end containing a plurality of motor electrical contacts;

lowering the pumping system into the string of tubing, landing the motor on the pedestal and engaging the motor electrical contacts with the pedestal electrical contacts; and pumping a dielectric flushing fluid down the tube and through the flushing fluid passage into the pedestal connector.

* * * * *